US007121289B1

(12) United States Patent
Anderson

(10) Patent No.: US 7,121,289 B1
(45) Date of Patent: Oct. 17, 2006

(54) EXPANDABLE MULTIUSER UMBRELLA

(76) Inventor: Ellen W. Anderson, 600 52nd Ave. South, St. Petersburg, FL (US) 33705

( * ) Notice: Subject to any disclaimer, the term of this patent is extended or adjusted under 35 U.S.C. 154(b) by 95 days.

(21) Appl. No.: 10/779,496

(22) Filed: Feb. 13, 2004

(51) Int. Cl.
*A45B 11/00* (2006.01)

(52) U.S. Cl. ..... 135/20.1; 135/25.1; 135/26; 135/33.2

(58) Field of Classification Search ..... 135/20.1, 135/20.3, 21, 26–27, 29, 25.32, 139, 141, 135/25.1, 33.2, 98, 155; D3/5–6; D26/28; 160/370.21, 370.23
See application file for complete search history.

(56) References Cited

U.S. PATENT DOCUMENTS 554,792 A * 2/1896 Pittenger et al. ..... 135/88.01
779,241 A * 1/1905 Schuller ..... 135/20.1
990,632 A * 4/1911 Burton ..... 135/20.1
3,464,431 A * 9/1969 Loeffler ..... 135/20.1
4,144,900 A * 3/1979 Kinski ..... 135/20.1
4,274,429 A * 6/1981 Kinski ..... 135/20.1
4,506,688 A * 3/1985 Bethoon et al. ..... 135/140
5,002,080 A * 3/1991 Ma ..... 135/20.1
D328,182 S * 7/1992 Lo ..... D3/5
5,263,505 A * 11/1993 Yeom ..... 135/20.1
6,192,967 B1 * 2/2001 Huang ..... 160/370.23
6,910,490 B1 * 6/2005 Villa ..... 135/20.1

* cited by examiner

*Primary Examiner*—Winnie Yip
(74) *Attorney, Agent, or Firm*—Kenneth L Tolar

(57) ABSTRACT

An expandable multiuser umbrella includes a pair of elongated telescoping shafts each having a plurality of expandable support struts radially extending therefrom. The support struts support a canopy member having two opposing side sections with an expandable intermediate section therebetween. The upper ends of the support shafts are interconnected with a telescoping arm allowing the shafts to be separated to expand the canopy intermediate section for accommodating multiple users. Alternatively, the shafts may be moved to a contiguous juxtaposed position thereby collapsing the intermediate section of the canopy allowing the umbrella to be comfortably used by a single person.

3 Claims, 2 Drawing Sheets

EXPANDABLE MULTIUSER UMBRELLA

BACKGROUND OF THE INVENTION

The present invention relates to an umbrella, specifically, an umbrella that is expandible allowing up to three persons to stand underneath.

DESCRIPTION OF THE PRIOR ART

Two or more people often get caught in a downpour when only one umbrella is available. In such event, two people will share the umbrella requiring one person to hold the umbrella while walking, which is cumbersome. Additionally, a conventional umbrella is typically not large enough to completely protect two persons, resulting in both getting wet.

Accordingly, there is currently a need for an umbrella that can effectively and comfortably accommodate multiple users. The present invention satisfies this need by providing a uniquely designed umbrella including an expandable intermediate section and two handles that allow the device to easily protect at least two users. Additionally, the umbrella can be collapsed and comfortably used by one person.

SUMMARY OF THE INVENTION

The present invention relates to an expandable umbrella for accommodating multiple users. The device comprises a pair of elongated telescoping shafts each having a handle at a lower end thereof. The upper ends of the shafts are interconnected with a telescoping cross arm allowing the shafts to move toward and away from each other. A spring-biased locking pin restrains the arm in an extended position. Radially extending from the upper end of each shaft are a plurality of collapsible support struts. Overlaying the support struts is a canopy member having a pair of side sections with a collapsible intermediate section therebetween.

Accordingly, to expand the umbrella to cover multiple users, the shafts are spread apart until the arm locks in the extended position. Simultaneously, the canopy member intermediate section expands allowing the umbrella to effectively accommodate two or possibly three persons. A single person can use the umbrella by depressing the locking pin and collapsing the arm until the two shafts are contiguously juxtaposed. Contemporaneously, the intermediate section of the canopy will collapse allowing the user to grasp both shaft handles to use the umbrella in a conventional fashion.

It is therefore an object of the present invention to provide an umbrella that can effectively accommodate multiple persons.

It is another object of the present invention to provide an umbrella that can be expanded to accommodate multiple persons or collapsed to accommodate a single person.

Other objects, features and advantages of the present invention will become readily apparent from the following detailed description of the preferred embodiment when considered with the attached drawings and the appended claims.

DESCRIPTION OF THE PREFERRED EMBODIMENT

Figure 2:
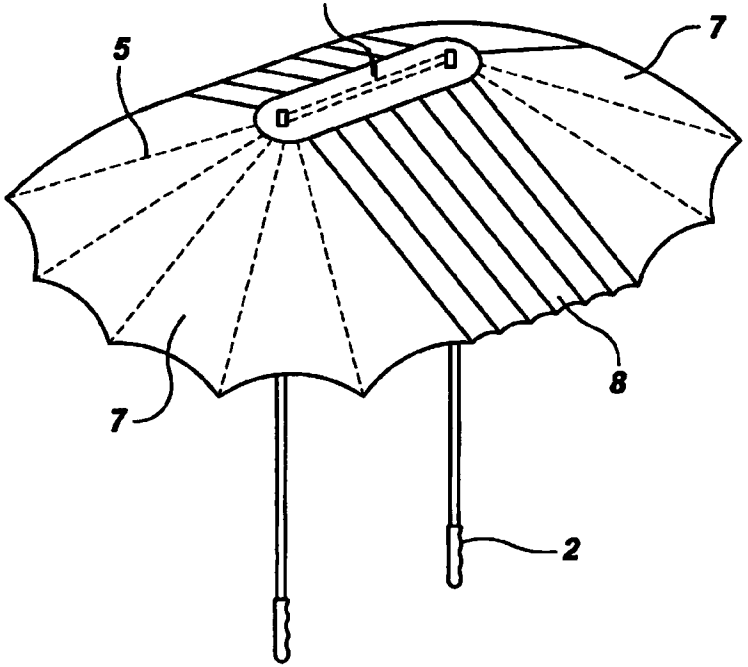
FIG. 2 is perspective view of the umbrella in an expanded position for accommodating multiple users.
Figure 1:
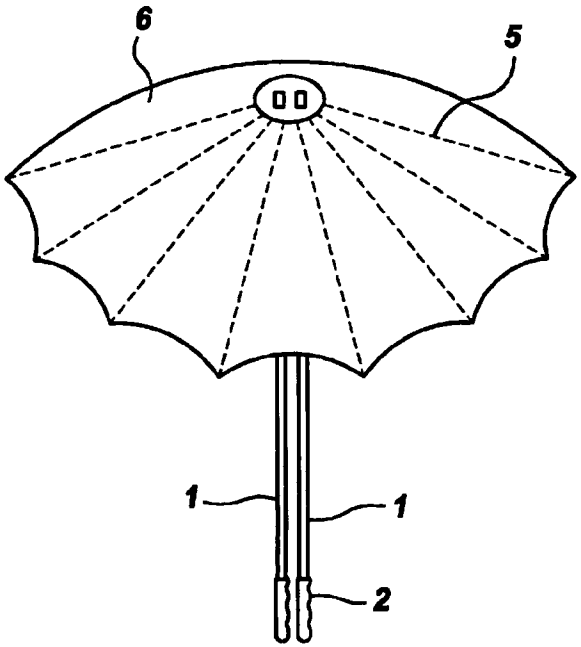
FIG. 1 is perspective view of the umbrella in a collapsed position for accommodating a single user.
Figure 3:
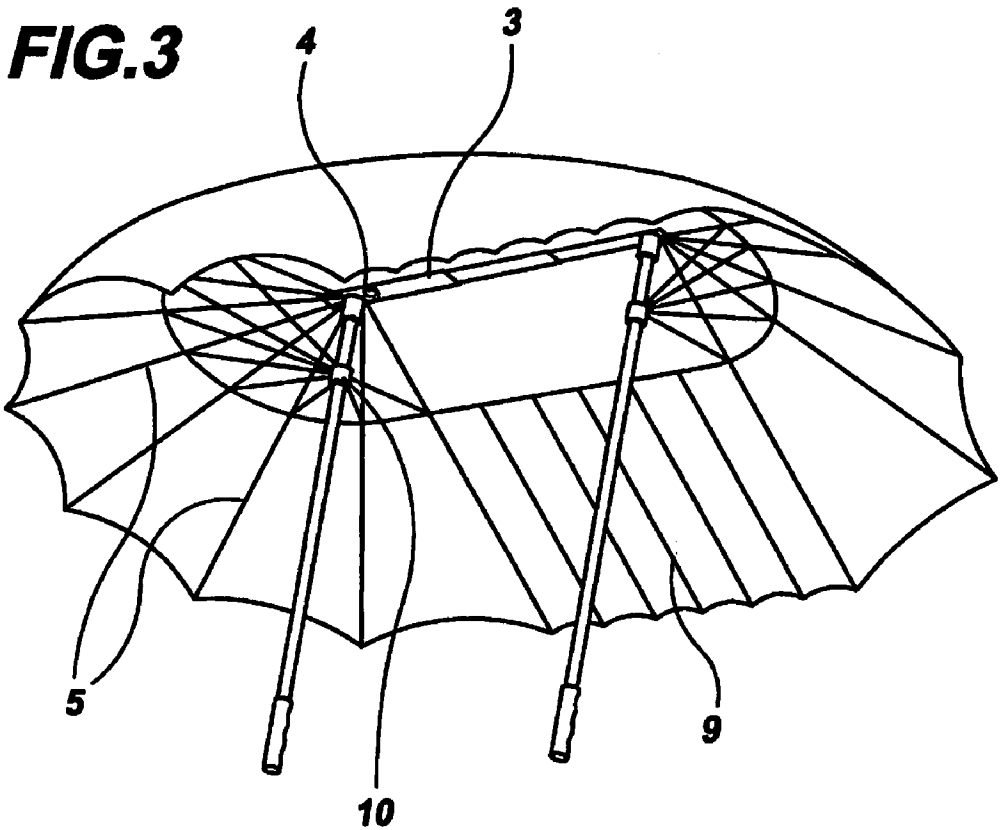
FIG. 3 is a bottom, perspective view of the umbrella in an expanded position.

Referring now to FIGS. 1–3, the present invention relates to an expandable umbrella for accommodating multiple users. The device comprises a pair of elongated telescoping shafts 1 each having a handle 2 at a lower end thereof. The upper ends of the shafts are interconnected with a telescoping cross arm 3 allowing the shafts to move toward and away from each other. A spring-biased locking pin 4 locks the arm in an extended position.

Radially extending from the upper end of each shaft are a plurality of support struts 5. An end of each strut is coupled to a sleeve 10 that is longitudinally slidable along the shaft for collapsing and expanding the struts in a conventional fashion. Overlaying the support struts is a canopy member 6 having a pair of side sections 7 with a collapsible intermediate section 8 therebetween. A plurality of ribs 9 support the intermediate section.

Accordingly, to expand the umbrella to cover multiple users, the shafts are spread apart until the arm locks in the extended position. Simultaneously, the canopy member intermediate section expands allowing the umbrella to effectively accommodate two or possibly three persons. Each of two persons can grasp one of the shaft handles allowing the users to comfortable walk while holding the umbrella.

To convert the umbrella to a single person device, a user depresses the locking pin and completely collapses the arm until the two shafts are contiguously juxtaposed as depicted in FIG. 1. Contemporaneously, the intermediate section of the canopy will collapse allowing the user to grasp both shaft handles to use the umbrella in a conventional fashion.

The present invention is not limited to the exact details of construction and enumeration of parts described above. Furthermore, the size, shape and materials of construction can be varied, if desired.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An expandable umbrella for accommodating multiple users comprising:

a pair of elongated telescoping shafts, each having an upper end and a lower end, with a handle at the lower end of each shaft for grasping by user;

a plurality of radially extending support struts at the upper end of each shaft, each of said support struts expandable to a substantially perpendicular orientation relative to said support shafts and collapsible thereagainst;

a canopy overlaying said support struts, said canopy including a pair of side sections with a collapsible intermediate section therebetween allowing said canopy to be expanded to accommodate multiple users;

a telescoping arm interconnecting an upper end of one of said shafts with the upper end of another of said shafts whereby said shafts are movable away from each other to expand the intermediate section of said canopy, or toward each other to a juxtaposed contiguous position, collapsing said arm and said intermediate section of said canopy for convenient use by a single user.

2. The umbrella according to claim 1 wherein said arm includes a spring-biased locking pin for locking said arm in an extended position.

3. The umbrella according to claim 2 wherein said intermediate section overlays a plurality of support ribs to enhance the structural integrity of said intermediate section when said intermediate section is expanded.

* * * * *